US009380811B2

(12) United States Patent
Chung

(10) Patent No.: US 9,380,811 B2
(45) Date of Patent: Jul. 5, 2016

(54) WET SCRUBBING ELECTRONIC CIGARETTE

(71) Applicant: Henry Chung, Walnut, CA (US)

(72) Inventor: Henry Chung, Walnut, CA (US)

( * ) Notice: Subject to any disclaimer, the term of this patent is extended or adjusted under 35 U.S.C. 154(b) by 381 days.

(21) Appl. No.: 14/203,870

(22) Filed: Mar. 11, 2014

(65) Prior Publication Data

US 2015/0257444 A1 Sep. 17, 2015

(51) Int. Cl.
*A24F 47/00* (2006.01)
*A24F 1/30* (2006.01)

(52) U.S. Cl.
CPC ..... *A24F 47/008* (2013.01); *A24F 1/30* (2013.01)

(58) Field of Classification Search
CPC ..... A24F 47/008; A24F 13/04; A24F 1/02; A24F 1/14
See application file for complete search history.

(56) References Cited

U.S. PATENT DOCUMENTS

2012/0000478 A1* 1/2012 Wagenhals ..... A24F 13/04 131/329
2012/0199572 A1* 8/2012 Shen ..... A61M 11/041 219/438
2013/0192620 A1* 8/2013 Tucker ..... H01C 17/00 131/329
2015/0122275 A1* 5/2015 Wu ..... A24F 47/008 131/329

* cited by examiner

*Primary Examiner* — Michael H Wilson
*Assistant Examiner* — Eric Yaary
(74) *Attorney, Agent, or Firm* — Clement Cheng

(57) ABSTRACT

The present invention removes particles entrained within a flow of vapor and cools vapor passing through a wet scrubbing section of an electronic cigarette. The wet scrubbing electronic cigarette includes an atomizer section having a battery section connection for connection to a battery section. The atomizer section has an atomizer heating section. A wet scrubbing section has a mouthpiece, a water chamber in fluid communication with the mouthpiece. The water chamber provides for scrubbing of incoming airflow. A tubular air passage assembly is held within the water chamber. The tubular air passage assembly is in fluid communication with the water chamber. A battery section powers the atomizer section.

10 Claims, 5 Drawing Sheets

WET SCRUBBING ELECTRONIC CIGARETTE

FIELD OF THE INVENTION

The present invention is in the field of electronic cigarettes.

DISCUSSION OF RELATED ART

A variety of different smoking apparatus have been made for smoking tobacco and other bulk dried material. For example in U.S. Pat. No. 8,534,296 by inventor Groff, issued Sep. 17, 2013, is entitled Smoking Apparatus With Filter and Cooling the disclosure of which is incorporated herein by reference. Groff uses an array of conical shaped diffusion screens to prevent water from flowing into the combustion area. Schweitzer in U.S. Pat. No. 4,357,948, issued Nov. 9, 1982, the disclosure of which is incorporated herein by reference, is entitled Smoke Filtering and Cooling Device. Schweitzer describes a water filtering and cooling tobacco smoking pipe having a cylindrical tube passage.

SUMMARY OF THE INVENTION

The present invention removes particles entrained within a flow of vapor and cools vapor passing through a wet scrubbing section of an electronic cigarette. The wet scrubbing electronic cigarette includes an atomizer section having a battery section connection for connection to a battery section. The atomizer section has an atomizer heating section. A wet scrubbing section has a mouthpiece, a water chamber in fluid communication with the mouthpiece. The water chamber provides for scrubbing of incoming airflow. A tubular air passage assembly is held within the water chamber. The tubular air passage assembly is in fluid communication with the water chamber. A battery section powers the atomizer section.

The tubular air passage assembly further includes a ball held within a ball chamber. The ball has an open position and a closed position. A ball seat is formed on an inside tube. The inside tube is fitted inside the outside tube. The outside tube connects with the ball chamber. An air gap is formed at a lower end of the outside tube.

The mouthpiece includes a mouthpiece bottom opening connected to a mouthpiece top opening. A mouthpiece flange has a mouthpiece O-ring mounted to an exterior surface of the mouthpiece. The mouthpiece O-ring makes a seal with the water chamber. The tubular air passage assembly also has a mouthpiece connector. The mouthpiece connector has a mouthpiece connector thread and a mouthpiece connector flat plate on a lower surface of the mouthpiece connector. The mouthpiece connector has a tubular air passage assembly opening. The mouthpiece connector is sized to receive the mouthpiece with a watertight seal.

The wet scrubbing section optionally has a scrubber section connector having a scrubber section connector opening providing a passage for vapor flow through the scrubber section connector. The water chamber further comprises a water chamber sidewall having a water chamber sidewall lower opening and a water chamber sidewall upper opening. A water chamber upper closure has a water chamber upper closure opening. The water chamber upper closure is fitted to the water chamber sidewall upper opening. A water chamber lower closure has a water chamber lower closure opening. The water chamber lower closure is fitted to the water chamber sidewall lower opening. A water chamber upper closure O-ring is formed on an external surface of the water chamber upper closure. The water chamber upper closure O-ring seals against the water chamber sidewall upper opening when the water chamber upper closure is fitted to the water chamber. A water chamber lower closure O-ring is formed on an external surface of the water chamber lower closure. The water chamber lower closure O-ring seals against the water chamber sidewall lower opening when the water chamber lower closure is fitted to the water chamber. The tubular air passage assembly optionally includes a tubular air passage assembly flange and an outside tube base. The outside tube base fits to the water chamber. The tubular air passage assembly flange extends from the outside tube base outside the water chamber so that an upper surface of the tubular air passage assembly flange abuts a lower surface of the water chamber lower closure.

Figure 1:
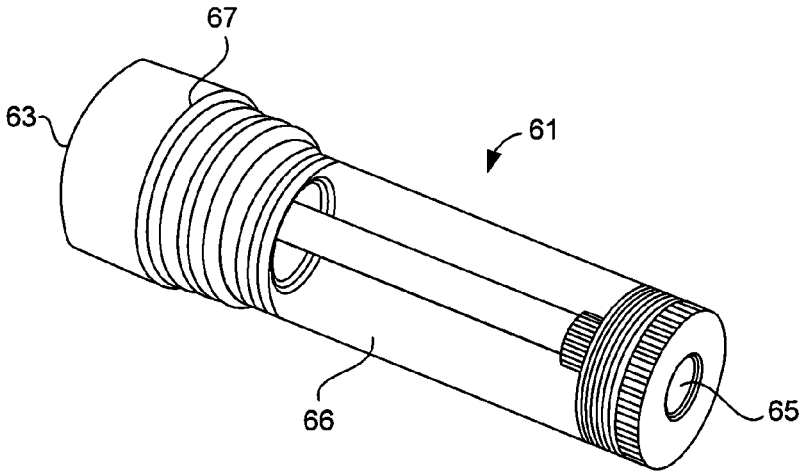
FIG. 1 is an example of an atomizing section of the electronic cigarette having an internal threaded adapter for connecting to a battery section.
Figure 2:
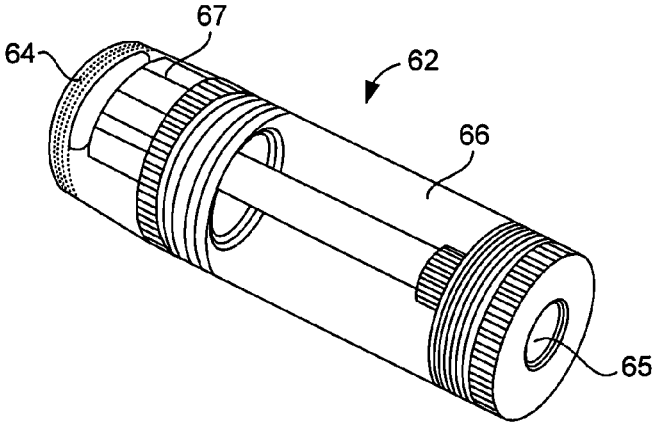
FIG. 2 is an example of an atomizing section of the electronic cigarette having an external threaded adapter for connecting to a battery section.
Figure 3:
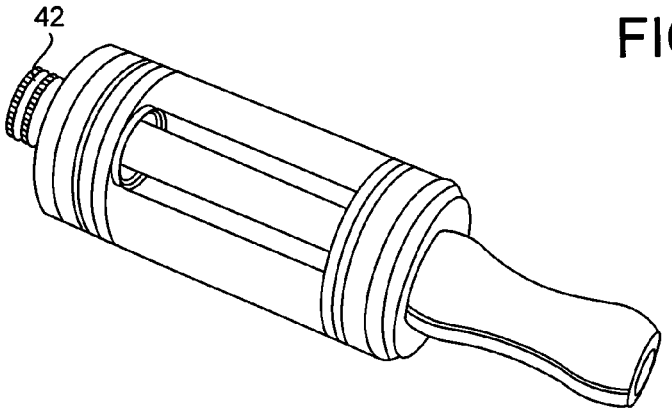
FIG. 3 is an example of the wet scrubber having a connector for connecting to the atomizing section.
Figure 4:
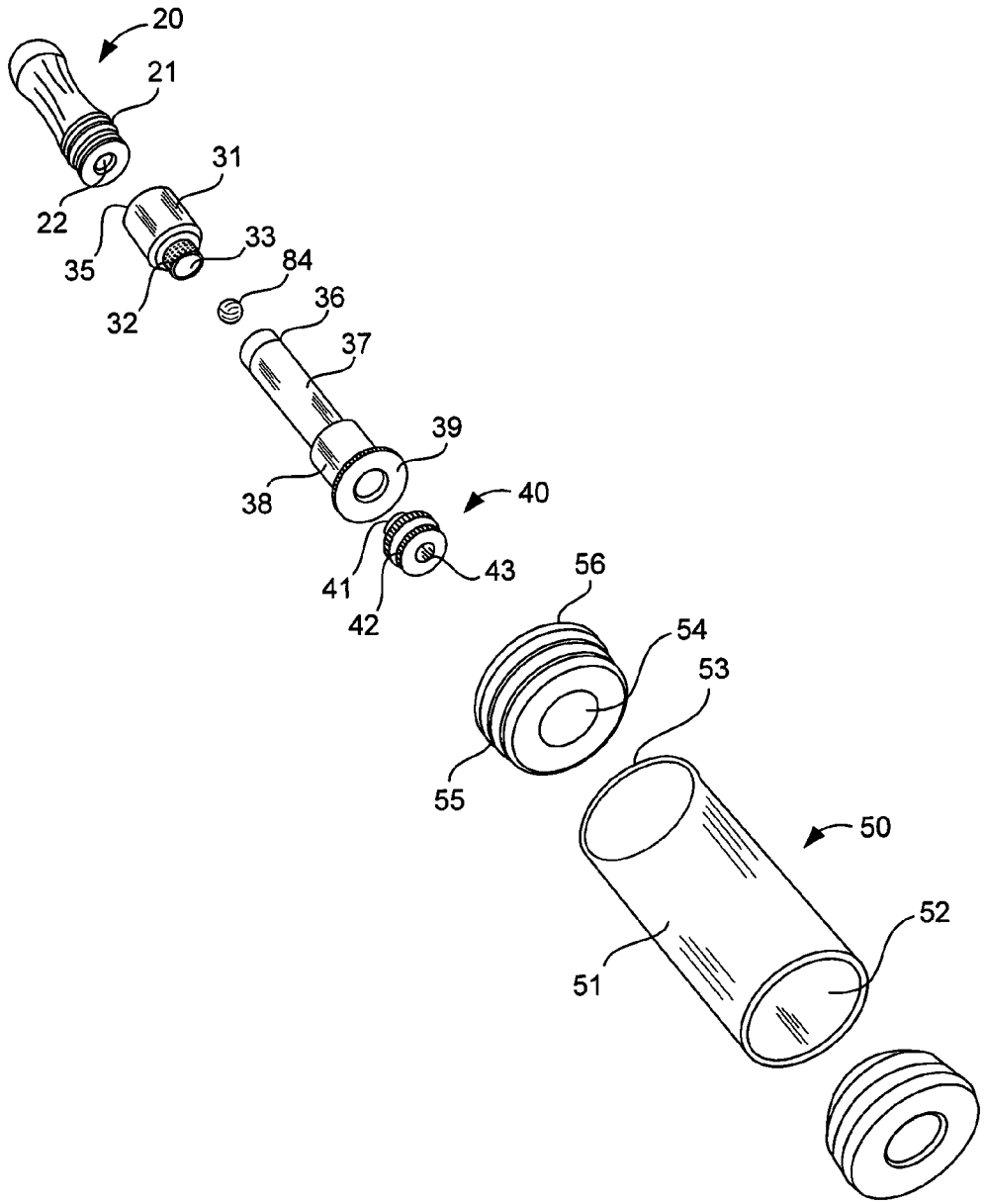
FIG. 4 is a rear exploded view of the wet scrubber section.
Figure 5:
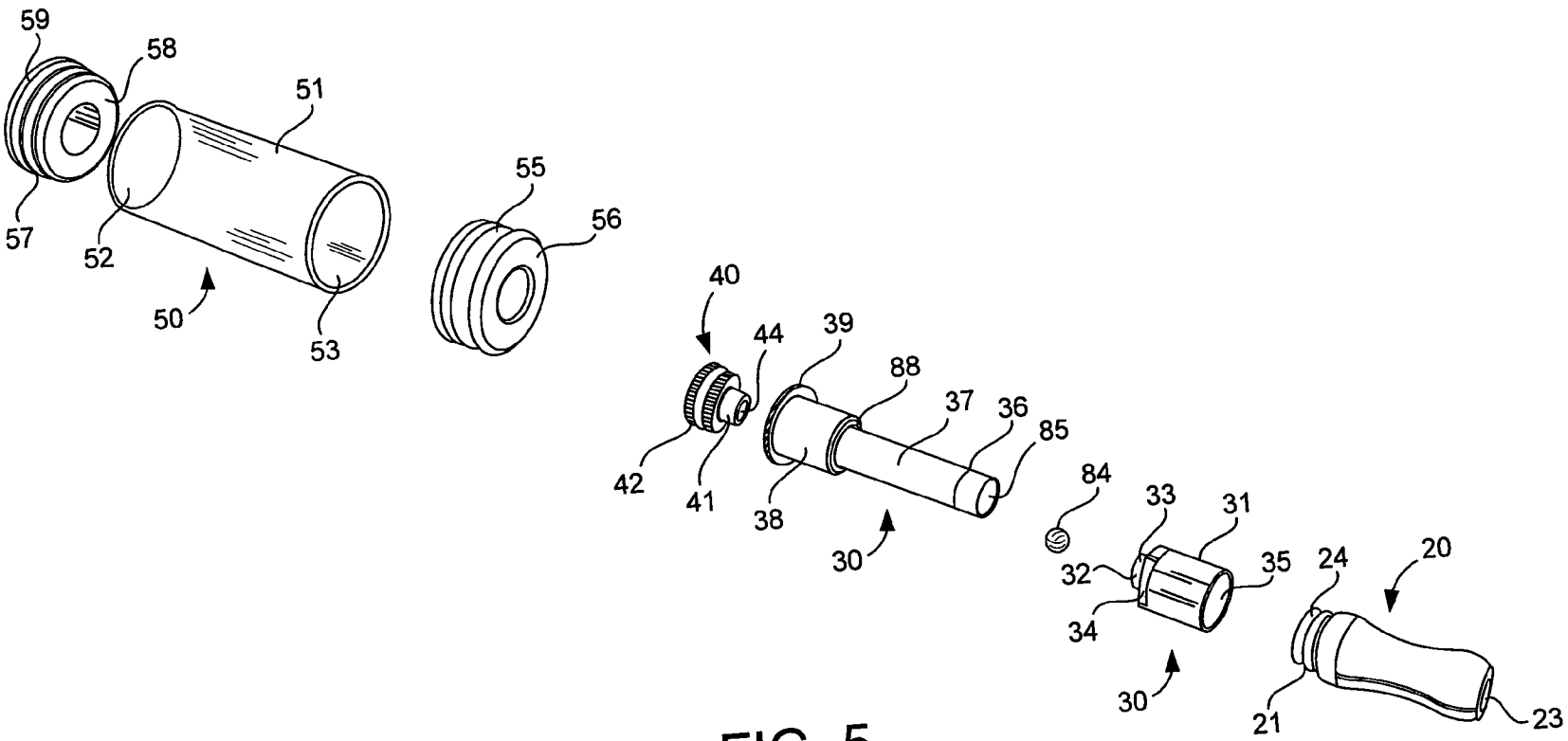
FIG. 5 is a front side exploded view of the wet scrubber section.
Figure 6:
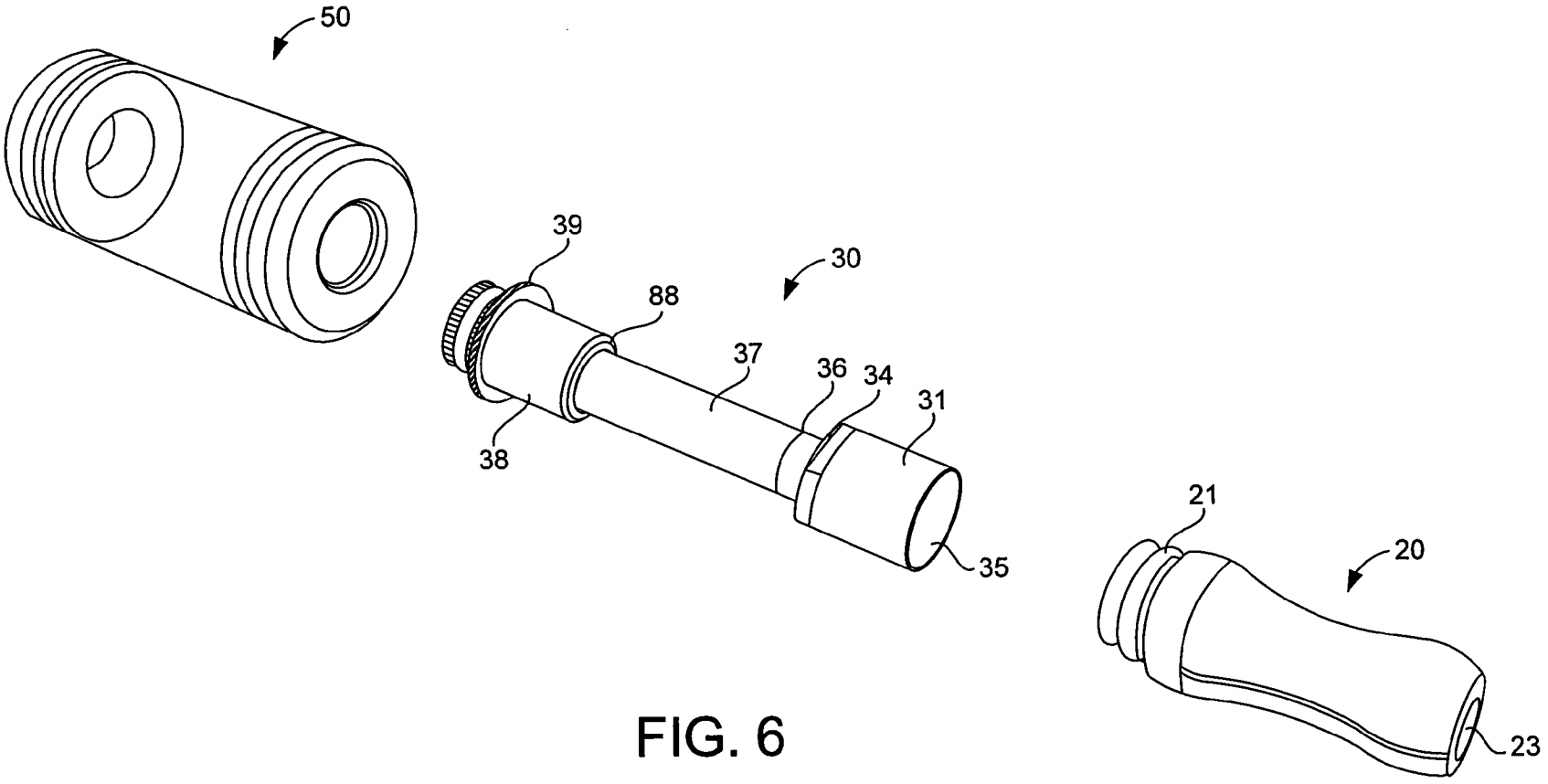
FIG. 6 is a front side exploded view of the wet scrubber section partially assembled.
Figure 7:
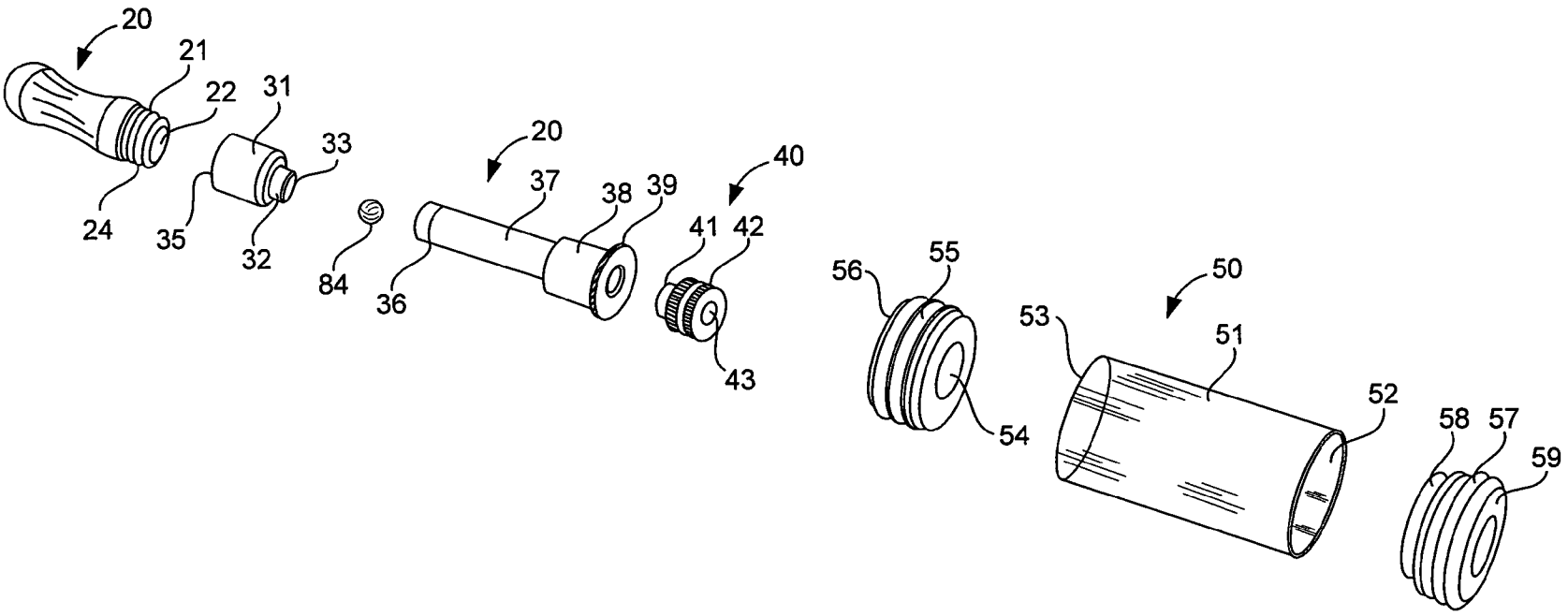
FIG. 7 is a side exploded view of the wet scrubber section.

The following callout list of elements can be a useful guide in referencing the element numbers of the drawings.

20 Mouthpiece
21 Mouthpiece O-Ring
22 Mouthpiece Bottom Opening
23 Mouthpiece Top Opening
24 Mouthpiece Flange
30 Tubular Air Passage Assembly
31 Mouthpiece Connector
32 Mouthpiece Connector Thread
33 Mouthpiece Connector Flat Plate
34 Tubular Air Passage Assembly Openings
35 Mouthpiece Connector Opening
36 Flat Plate Connector
37 Outside Tube
38 Outside Tube Base
39 Tubular Air Passage Assembly Flange
40 Scrubber Section Connector
41 Scrubber Section Adapter Protrusion
42 Scrubber Section Connector Thread
43 Scrubber Section Connector Opening
50 Water Chamber
51 Water Chamber Side Wall
52 Water Chamber Sidewall Lower Opening
53 Water Chamber Side Wall Upper Opening
54 Water Chamber Upper Closure Opening
55 Water Chamber Upper Closure O-Ring
56 Water Chamber Upper Closure
57 Water Chamber Lower Closure O-Ring
58 Water Chamber Lower Closure
59 Water Chamber Lower Closure Opening
61 Atomizing Section Having Internal Threaded Battery Section Connection
62 Atomizing Section Having External Threaded Battery Section Connection
63 Internal Threaded Battery Section Connection

64 External Threaded Battery Section Connection
65 Atomizing Section Exhaust Opening
66 Atomizer Fluid Reservoir
67 Atomizer Heating Section
84 Ball
85 Ball Seat
86 Inside Tube
88 Air Gap
89 Water Level

DETAILED DESCRIPTION OF THE PREFERRED EMBODIMENT

The present invention has a wet scrubber located in a water chamber. The water chamber section is connected to the atomizing section and the atomizing section is connected to a battery section. The atomizing section receives electricity from the battery section and creates a vapor by heating a substance. The atomizing section having internal threaded battery section connection 61 has an internal threaded battery section connection 63. The atomizing section having an external threaded battery section connection 62 has an external threaded battery section connection 64. The atomizer fluid reservoir 66 may have a liquid or gel suspended in a fibrous media that wicks to a heater for atomizing a nicotine fluid at an atomizer heating section 67. The atomizing section exhaust opening 65 exhausts vapor and airflow to the water chamber 50.

The water chamber 50 has a cylindrical shaped water chamber side wall 51. The water chamber's side wall 51 connects to the water chamber lower closure 58 and the water chamber upper closure 56. The water chamber upper closure 56 connects to the water chamber side wall upper opening 53. The water chamber lower closure 58 connects to the water chamber sidewall lower opening 52. The water chamber upper closure 56 has a water chamber upper closure opening 54. The water chamber lower closure 58 has a water chamber lower closure opening 59. The water chamber upper closure O-ring 55 is mounted on an external surface of a shoulder of the water chamber upper closure 56 so that the water chamber upper closure O-ring 55 makes a watertight connection with an inside surface of the water chamber sidewall upper opening 53. The water chamber lower closure O-ring 57 is mounted on an external surface of a shoulder of the water chamber lower closure 58 so that the water chamber lower closure O-ring 57 makes a watertight connection with an inside surface of the water chamber side wall lower opening 52.

The vapor exits the water chamber 50 and enters a mouthpiece 20. The mouthpiece is sealed to the water chamber 50 at a mouthpiece O-ring 21. The mouthpiece O-ring 21 is mounted on an external surface of a mouthpiece flange 24. The mouthpiece 20 has a mouthpiece top opening 23 that a user draws airflow and vapor through. The mouthpiece top opening 23 is in fluid communication with the mouthpiece bottom opening 22. Optionally, a filter screen can be placed between the mouthpiece top opening 23 and the mouthpiece bottom opening 22. The mouthpiece should be made removable for easy cleaning.

A tubular air passage assembly 30 fits in the water chamber 50 to provide containment for the water. The tubular air passage assembly 30 has an upper end that has is sealed to the water chamber 50 and tubular air passage assembly 30 has a lower end that is sealed to the water chamber 50. More specifically, the tubular air passage assembly 30 has a mouthpiece connector 31 that has an external surface that receives the water chamber upper closure O-ring 55 and makes a watertight seal. The mouthpiece connector 31 has an inside surface which defines the mouthpiece connector opening 35 for receiving the mouth piece O-ring 21. The mouthpiece connector 31 may have a mouthpiece connector thread 32. The mouthpiece connector 31 terminates in a mouthpiece connector flat plate 33 which is preferably solid and does not have fluid communication to the mouthpiece connector opening.

The internal surface of the mouthpiece connector opening 35 has a pair of openings called the tubular air passage assembly openings 34. The tubular air passage assembly openings 34 can be milled or cut into a sidewall surface of the mouthpiece connector 31 so that the mouthpiece connector 31 has a pair of tubular air passage assembly openings 34 on opposite sides of an external surface of the mouthpiece connector 31.

The mouthpiece connector 31 is preferably secured to the flat plate connector 36. The flat plate connector 36 receives the mouthpiece connector thread 32 after the ball has been placed within the ball chamber. The ball chamber is within the flat plate connector 36. The ball has an open and closed position. When the ball is seated in a ball seat, the airflow is stopped. When the ball is unseated, the airflow is continuous. The flat plate connector 36 is an upper portion of the outside tube 37. The outside tube 37 is connected to the outside tube base 38. The outside tube base has a tubular air passage assembly flange 39.

A scrubber section connector 40 connects the scrubber section to the atomizing section 61, 62. A scrubber section connector opening passes through the middle of the scrubber section connector 40 and provides an air conduit to the atomizing section 61, 62. The scrubber section connector 40 preferably has a scrubber section adapter protrusion 41 that adapts to an interior surface of the tubular air passage assembly flange opening of the tubular air passage assembly flange 39.

The ball 84 has an open position and a closed position. The ball is in the open position when a user inhales and the ball is in a closed position when the user stops inhaling. When a user does not inhale, the ball seats back onto the ball seat 85. The ball 84 can be formed of metal such as a metal ball bearing. The ball 84 abuts the mouthpiece connector flat plate 33 when the ball is unseated during inhalation. Because the mouth piece connector flat plate 33 seals against the inside of the outside tube 37, the ball 84 is held within the ball chamber to provide a one-way valve. The ball 84 sits atop the inside tube 86 on the ball seat 85 which is a top edge of the inside tube 86. The inside tube 86 is held within the outside tube 37. The outside tube 37 has an opening between itself and the outside tube base 38 so that an air gap 88 is formed to allow vapor to flow from the scrubber section connector thread 42 through the inside tube 86 and exit the air gap 88. The vapor exits the air gap 88 as bubbles. The vapor bubbles float upward and break at the water level 89. While underwater, the bubbles are cleaned and cooled so that the flow of a cooled and cleaned vapor can continue through the tubular air passage assembly openings 34 and continue upward through the mouthpiece 22 to the user.

The inside tube 86 is preferably of a thinner wall material having a smaller thickness than the outside tube 86. The inside tube 86 is free at a top end of the inside tube and connected only to the outside tube base 38 at a lower end of the inside tube 86. The outside tube may have an opening that leads to the air gap 88. The opening can be a circular drilled opening and the air gap 88 is in the shape of a ring that passes around the circumferential periphery of the outside tube 37.

The invention claimed is:

1. A wet scrubbing electronic cigarette comprising:

a. an atomizer section having a battery section connection for connection to a battery section, wherein the atomizer section has an atomizer heating section;

b. a wet scrubbing section comprising:

i. a mouthpiece;

ii. a water chamber in fluid communication with the mouthpiece, wherein the water chamber provides for scrubbing of incoming airflow;

iii. a tubular air passage assembly held within the water chamber, wherein the tubular air passage assembly is in fluid communication with the water chamber; and c. a battery section powering the atomizer section;

wherein the tubular air passage assembly further comprises:

a. a ball held within a ball chamber, wherein the ball has an open position and a closed position;

b. a ball seat formed on an inside tube, wherein the ball seat is a top edge of the inside tube;

c. an outside tube wherein the inside tube is fitted inside the outside tube, wherein the outside tube connects with the ball chamber;

d. an air gap formed at a lower end of the outside tube.

2. The wet scrubbing electronic cigarette of claim 1, wherein the mouthpiece further comprises: a mouthpiece bottom opening connected to a mouthpiece top opening; and a mouthpiece flange having a mouthpiece O-ring mounted to an exterior surface of the mouthpiece, wherein the mouthpiece O-ring makes a seal with the water chamber.

3. The wet scrubbing electronic cigarette of claim 1, wherein the tubular air passage assembly further comprises: a mouthpiece connector, wherein the mouthpiece connector has a mouthpiece connector thread and a mouthpiece connector flat plate on a lower surface of the mouthpiece connector, wherein the mouthpiece connector has a tubular air passage assembly opening, wherein the mouthpiece connector is sized to receive the mouthpiece with a watertight seal.

4. The wet scrubbing electronic cigarette of claim 1, wherein the wet scrubbing section further includes a scrubber section connector having a scrubber section connector opening providing a passage for vapor flow through the scrubber section connector.

5. The wet scrubbing electronic cigarette of claim 1, wherein the water chamber further comprises:

a. a water chamber sidewall having a water chamber sidewall lower opening and a water chamber sidewall upper opening;

b. a water chamber upper closure having a water chamber upper closure opening, wherein the water chamber upper closure is fitted to the water chamber sidewall upper opening;

c. a water chamber lower closure having a water chamber lower closure opening, wherein the water chamber lower closure is fitted to the water chamber sidewall lower opening;

d. a water chamber upper closure O-ring formed on an external surface of the water chamber upper closure, wherein the water chamber upper closure O-ring seals against the water chamber sidewall upper opening when the water chamber upper closure is fitted to the water chamber; and e. a water chamber lower closure O-ring formed on an external surface of the water chamber lower closure, wherein the water chamber lower closure O-ring seals against the water chamber sidewall lower opening when the water chamber lower closure is fitted to the water chamber.

6. The wet scrubbing electronic cigarette of claim 1, wherein the tubular air passage assembly further comprises: a tubular air passage assembly flange; and an outside tube base, wherein the outside tube base fits to the water chamber, and wherein the tubular air passage assembly flange extends from the outside tube base outside the water chamber so that an upper surface of the tubular air passage assembly flange abuts a lower surface of the water chamber lower closure.

7. The wet scrubbing electronic cigarette of claim 5, wherein the mouthpiece further comprises: a mouthpiece bottom opening connected to a mouthpiece top opening; and a mouthpiece flange having a mouthpiece O-ring mounted to an exterior surface of the mouthpiece, wherein the mouthpiece O-ring makes a seal with the water chamber.

8. The wet scrubbing electronic cigarette of claim 5, wherein the tubular air passage assembly further comprises: a mouthpiece connector, wherein the mouthpiece connector has a mouthpiece connector thread and a mouthpiece connector flat plate on a lower surface of the mouthpiece connector, wherein the mouthpiece connector has a tubular air passage assembly opening, wherein the mouthpiece connector is sized to receive the mouthpiece with a watertight seal.

9. The wet scrubbing electronic cigarette of claim 5, wherein the wet scrubbing section further includes a scrubber section connector having a scrubber section connector opening providing a passage for vapor flow through the scrubber section connector.

10. The wet scrubbing electronic cigarette of claim 5, wherein the tubular air passage assembly further comprises: a tubular air passage assembly flange; and an outside tube base, wherein the outside tube base fits to the water chamber, and wherein the tubular air passage assembly flange extends from the outside tube base outside the water chamber so that an upper surface of the tubular air passage assembly flange abuts a lower surface of the water chamber lower closure.

* * * * *